United States Patent [19]

Saik et al.

[11] 4,312,118

[45] Jan. 26, 1982

[54] METHOD FOR PRODUCING SPEAKER CONSTRUCTION

[75] Inventors: John D. Saik, Brownsville, Tex.; Jack A. English, Elkhart, Ind.

[73] Assignee: CTS Corporation, Elkhart, Ind.

[21] Appl. No.: 134,927

[22] Filed: Mar. 28, 1980

[51] Int. Cl.[3] ..... H04R 31/00

[52] U.S. Cl. ..... 29/594; 29/464; 29/606; 179/115.5 VC

[58] Field of Search ..... 29/594, 606, 464; 179/115.5 VC, 115.5 PC

[56] References Cited

U.S. PATENT DOCUMENTS 3,225,860 12/1965 Fox ..... 181/31

3,967,367 7/1976 Hayes et al. ..... 29/594

*Primary Examiner*—Carl E. Hall

*Attorney, Agent, or Firm*—John A. Young; Larry J. Palguta

[57] ABSTRACT

An inexpensive minimum component loudspeaker which dispenses with the need for either a spider or top plate, consisting of a back plate having a centrally disposed hollow post, an annular permanent magnet mounted on the back plate and closely adjacent the post, and a basket having a central portion lying flat against the permanent magnet and including a central opening concentric with the post and a folded back annular flange which lies flatly against the base of the basket to form a double layer of metallic material disposed closely adjacent the confronting surface of the post to form an air gap. The additional metallic material channels the magnetic lines so that there is a maximum concentration of gauss lines within the air gap. A single piece combination cone and dust cover having mounted thereto a bobbin with coils to form a voice coil is precisely located in relation to the air gap by means of a collapsible shim gauge. The shim gauge has locating fingers which extend through the central opening of the post and precisely locate the voice coil in relation to the air gap. After the described location is effected, the outer periphery of the cone is adhesively joined to the major diameter end of the basket by means of a heat polymerized adhesive, following which the gauge is removed and the voice coil is permanently and reliably located in an accurately defined position. A series of openings are disposed about the basket to provide free venting of air and thereby prevent distortion during operation.

10 Claims, 7 Drawing Figures

METHOD FOR PRODUCING SPEAKER CONSTRUCTION

BACKGROUND OF THE INVENTION

The prior art has attempted to produce loudspeakers from a few number of components in order to create an economy of both manufacture in the method of assembly and economy in the finished product because of the reduction and simplicity of the component parts. The prior art has endeavored to simplify the construction and method of manufacture by reducing to an absolute minimum the number of components of the loudspeaker, with varying degrees of success. See, for example, prior art United States Pat. No. 3,453,400 entitled FIELD STRUCTURE FOR MAGNETIC LOUDSPEAKER AND METHODS OF MANUFACTURE issued July 1, 1969. In the present invention, there is a reduction of the number of components to a base plate, magnet, speaker coil, cone and housing. It is an important feature of the present invention that there be a concentration in gauss lines to a maximum extent at the gap wherein the speaker coil operates, since the responsiveness of the speaker, its sensitivity and performance, is directly related to the gauss concentration. This characteristic, that the entire range of movement of the speaker coils is wholly within the field of concentrated gauss lines, improves the response and is consistent with the objective of improving sensitivity. All of this is achievable if there is a small air gap having maximum gauss concentration and which includes the total range of placement of the speaker coil, and a lightweight readily responsive and inertia free diaphragm operated by the speaker coil and which is at all times mechanically unimpeded by the closely adjacent mechanical structure defining the gap in which the speaker coil moves.

While the need for an inexpensive loudspeaker has remained a long standing problem of the art, the response of the art has failed to achieve an absolutely economically reduced number of speaker parts, all of which function together to provide a speaker of high fidelity and response and at a low cost of manufacture. A further illustration of the problem intended to be solved by the present invention is illustrated in U.S. Pat. No. 3,792,526 "METHOD OF SOUND TRANSDUCER CONSTRUCTION" in which a substantial number of component parts and manufacture are required for the accurate disposal of the voice coil within the air gap defined by the magnetic structure. Additionally, reference is made to U.S. Pat. No. 3,967,367 entitled "METHOD FOR ALIGNING LOUDSPEAKER DIAPHRAM AND VOICE COIL ASSEMBLY" which is illustrative of the problem entailed in the accurate disposition of the voice coil relative to the magnetic gap defined by the voice coil and the adjacent metallic structure. Both of these patents illustrate the expense and complexity entailed in attempting to accurately locate the speaker coil with auxiliary structure which adds to the expense of assembly and inherent cost in the number of components necessary.

SUMMARY OF THE INVENTION

A principal object of the present invention is to provide a high fidelity speaker construction which is responsive and yet consists of a relatively few number of components, the components essentially reduced to the minimum number, i.e., a base plate, a metallic basket housing, a speaker cone, and a voice coil carried by said speaker cone and adapted to vibrate the speaker cone to transduce an electrical current to an acoustic signal.

Another object of the present invention is to provide a one-piece speaker cone and dust cover which includes a diaphragm cone section adapted for adhesive joining with a voice coil in which wire coils are wound on a bobbin which can be positioned in the working gap from the back side or bottom of the loudspeaker.

Another object of the present invention is to eliminate such previously required items as a washer or top plate, a spider or other components utilized in mounting the voice coil, and still be able to locate the voice coil precisely in its proper functional location.

An important object of the present invention is to provide a new and useful method of assembly of a speaker of the construction before described, and in which a collapsible shim gauge is utilized to temporarily locate the voice coil at its appropriate location within the air gap, and after such location the speaker cone is adhesively joined at its outer periphery to the confronting edges of the basket or housing thereby mounting the voice coil. The combination is then dried for a permanent connection, and the collapsible shim gauge removed.

It is an important feature of the present invention that there can be obtained an air gap within which the gauss lines are concentrated by adapting a portion of the base of the basket housing as a turned back section to increase the amount of metallic material surrounding the gap thereby effectively directing the gauss lines in the circuit to be of maximum density within the gap and which includes the entire range of movement of the voice coil. This increases the range of frequency developed as a sound output of the diaphragm.

Another important object of the present invention is the disposition of a number of venting openings in the housing so as to preclude any vacuum or pressure build-up within a chamber defined by the cone assembly and housing. Vibration of the cone assembly is unimpeded because the openings eliminate interference with the free movement of the cone assembly and voice coil within the prescribed range of movement. Thus, the voice coil will not be inadvertently displaced out of its prescribed lateral movement to mechanically engage adjoining structure thereby disrupting the effectiveness of transducing the electric signal to an acoustic signal output.

Consistent with the foregoing object of the reduction of the number of components to the absolute minimum number, it is possible to assemble the components in accordance with an improved method of lending itself to large scale production. The result is both an improved process and improved construction features, and an extremely low cost product is producible but which exhibits high fidelity and responsiveness.

The above and other features of the invention will become apparent from a consideration of the following description which proceeds with reference to the following drawings in which an example embodiment is illustrated by way of illustration and not by way of limitation.

DRAWINGS

FIG. 1 is an isometric exploded view of the components comprising the loudspeaker assembly;

FIG. 2 is a cross-sectional view illustration of the collapsible shim gauge in dotted line position before insertion, and in full line position after insertion through the post of the back plate in order to locate accurately the voice coil; the dotted line position of the diaphragm or cone is before adhesive joining with the basket housing and the full line position depicts the cone after attachment to the basket housing, with the voice coil accurately positioned by the collapsible shim gauge;

DETAILED DESCRIPTION OF THE INVENTION

Figure 1:
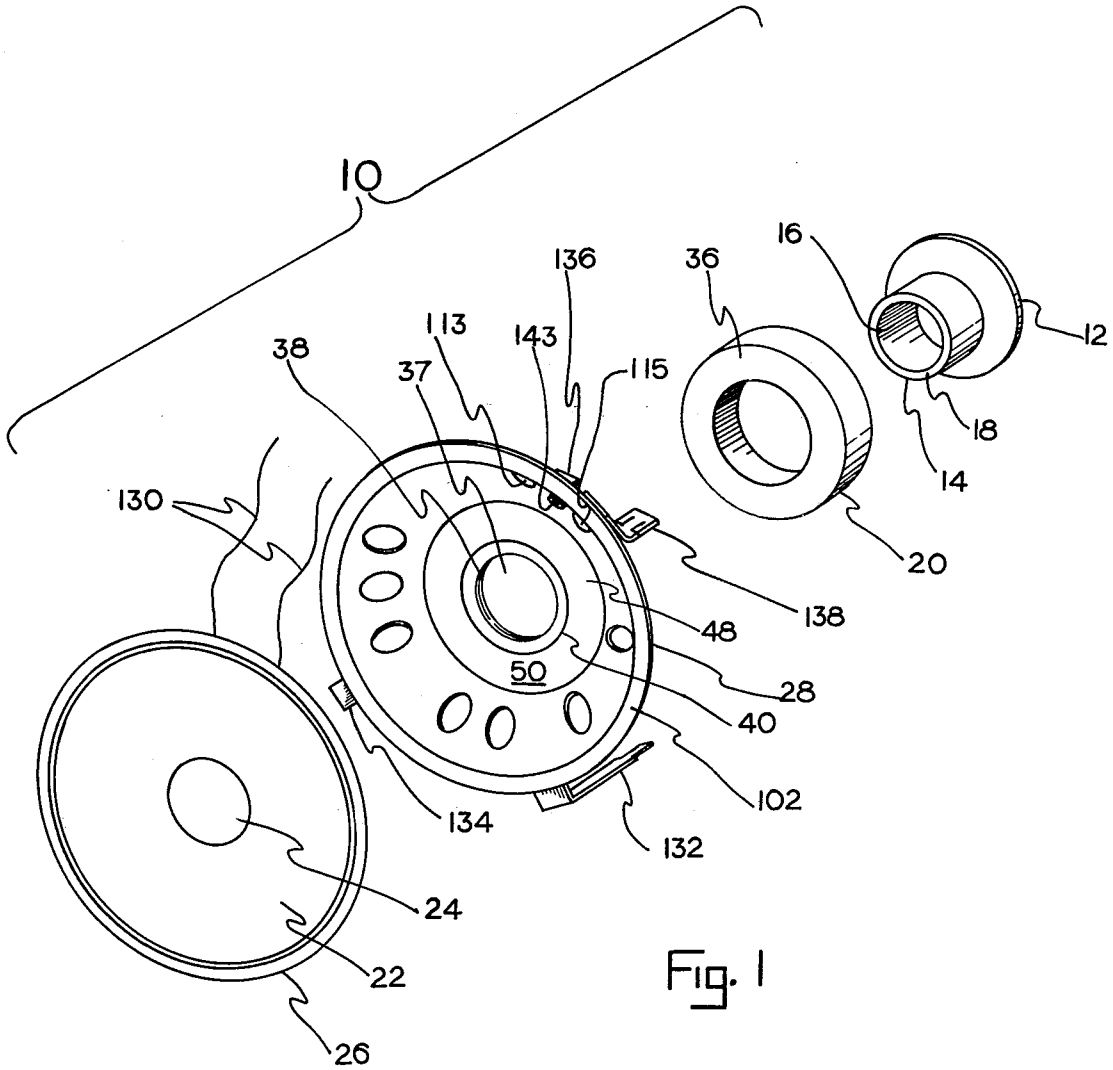
Figure 2:
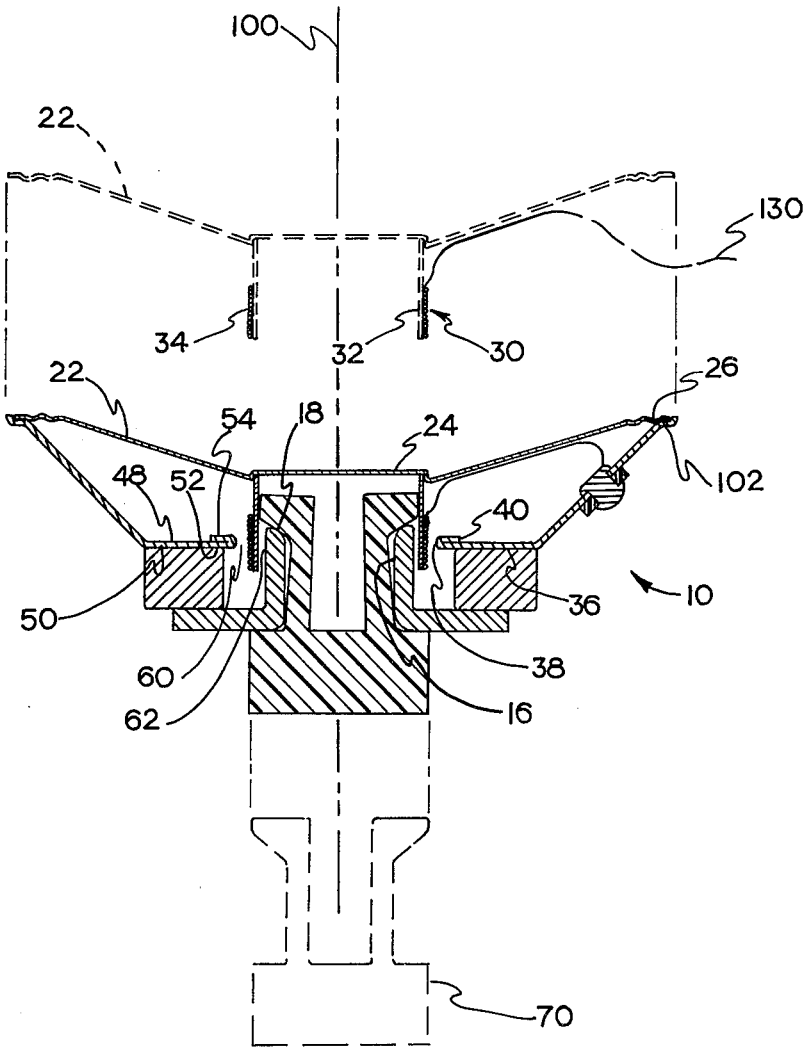

Referring now to the drawings, and particularly to FIGS. 1 and 2, there is illustrated a loudspeaker designated generally by reference numberal 10 having a back plate 12 of magnetically permeable material and including a centrally disposed post 14 projecting upward and having a hollow core 16 and terminating in a tapered edge 18, the taper being outwardly, for a purpose later to be described in connection with the direction of gauss lines. The back plate has mounted thereon a permanent annular magnet 20 consisting typically of a one-half ounce ferrite magnet, a typical construction being 1.25 inches outer diameter by 0.7 inches inner diameter and 0.2 inches thick. The magnet is located and assembled onto the back plate 12 by means of a standard adhesive.

Figure 3:
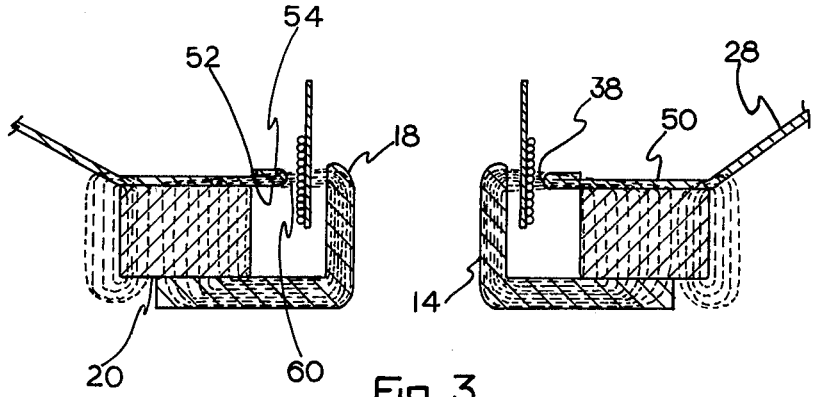
FIG. 3 is an enlarged detailed view illustrating the gauss line distribution developed by the permanent magnet.

A basket 28 is adhesively joined to the face 36 of the magnet 20, there being a center opening 37 defined by a rounded surface 38 developed when end 40 is reversly bent and formed flatly against surface 48 constituting a base 50 of basket 28. There is a double metallic layer consisting of layers 52 and 54 in the region of air gap 60 between rounded surface 38 and the confronting surface of the post 14. As a consequence, the gauss lines follow the magnetically permeable metallic layers 52, 54 and the post 14, as illustrated in FIG. 3, thereby enhancing the control and concentration of gauss lines and contributing to the sensitivity and response of the speaker. It should be noted that the tapered edge 18 of the post 14, terminating as it does in an angled edge, assists in the direction of the gauss lines.

A diaphragm or cone designated generally by reference numeral 22 consists of a blanked and hot formed fiber material wherein the diaphragm 22 and dust cover 24 are formed integrally from paper stock which provides a resonance of approximately 450 Hz. and a useable frequency response from 500 Hz to 5000 Hz. without necessitating edge or body treatment. Preferably, the paper is waterproof although this is not essential. The paper has a peripheral pleated section 26 intimately adhesively joined to a basket or housing 28. Prior to such connection, there is attached to the cone or diaphragm 22 a voice coil designated generally by reference numeral 30 and consisting of a bobbin 32 of standard laminate. There is wound over the voice coil two layers of standard copper wire 34 having a high impedance of 32 ohms and 64 ohms. Also usable is alloy wire having a resistivity of approximately 3 times that of copper, such a product lending itself to high production machines. Thirty-two ohm coils made up of two layers consisting of about 90 turns in total form the voice coil windings. Reference to number and size illustrate examples of construction and are not intended to be interpreted as critical of the invention but only illustrative of one of preferred embodiments. The fully wound voice coil 30 is adhesively joined to the center portion of the cone or diaphragm 22 in the region of the dust cover 24, the concentricity of the parts being controlled by a recess formed in the cone assembly.

The goal is to locate accurately the voice coil 30 within the gap 60 so that the coil can move freely within this concentrated gauss region without mechanical interference with the full range of voice coil movement needed to develop the correspondingly full range of vibrations of the diaphragm 22 as the diaphragm effects an acoustical output in response to current flow within the coil. The total operation is considered a transducing of electrical energy to an acoustical signal, and the effectiveness of this transducing is directly related to the location and characteristics of the gauss lines throughout the limit of the range of movement of the voice coil. That is, as the voice coil 30 moves it should be within a field in which the gauss line density does not change regardless of the position or displacement level of the coil. These effects are achieved in the present invention because of the gauss line concentration and a minimization of the air gap 60 thereby preventing leakage or dissipation of the gauss lines. Because of the narrowness of the gap and the limited traversing movement of the coil, it is necessary to accurately locate the coil, this being achieved in the manner next to be described.

Figure 7:
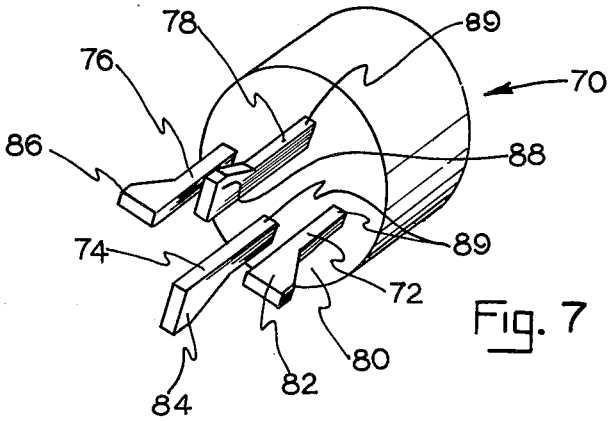

Referring to FIGS. 2 and 7, a collapsible shim gauge designated generally by reference numeral 70 includes four resilient gauge members 72, 74, 76 and 78 projecting upwardly from the base 80. Gauge members 72, 74, 76, 78 have outwardly projecting cam bosses 82, 84, 86, 88, respectively, which serve as locating cams once the gauge is located in the manner shown in FIG. 2. In order to achieve this, the gauge 70 is force fitted into the back plate 12 so that as the cam bosses 82, 84, 86, and 88 enter the core 16 of the post 14 they are forced together, the resilience of gauge members 72, 74, 76, 78 permitting this. After the cam bosses pass through the hollow core 16, they spring outwardly with the shank portions 89 being pressed firmly against the inner surface of the hollow core 16. There is thus defined accurately, in a radial sense, the proper location for the voice coil 30. The bobbin 32 is positioned downwardly, and the inner surface of the bobbin is accurately located by cam bosses 82, 84, 86, 88 relative to a central axis designated generally be reference numeral 100 in FIG. 2. Thus, the axial and radial positions of the voice coil 30 are precisely located in relation to the air gap 60, and once this is achieved the peripheral pleated section 26 of the cone 22 is adhesively joined to an annular recess 102 of the basket or housing 28. After the adhesive joint is fully cured, the collapsible shim gauge 70 is retracted, it being noted that the inclined undersurface of each of the cam bosses 82, 84, 86, and 88 engage the tapered edge 18 of the post 14 causing the bosses 82, 84, 86, 88 to be biased inwardly and permitting withdrawal of the gauge 70 through the hollow core 16. The voice coil 30 is now accurately located and remains in its accurate position because it is suspended by the diaphragm or cone 22 in the proper operative position.

Figure 4:
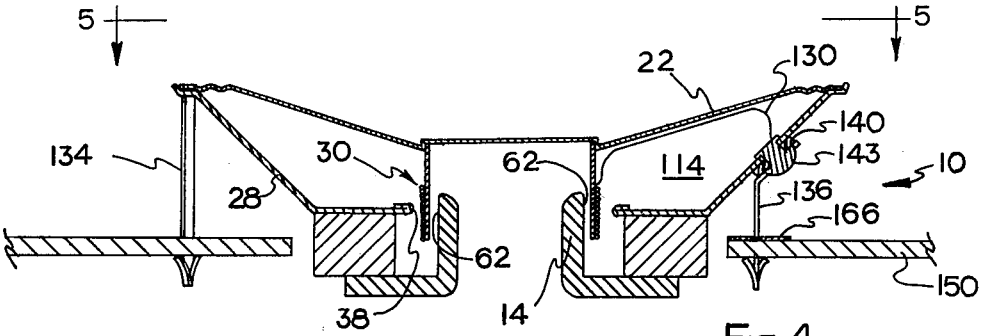
FIG. 4 is a sectional view illustrating a method for twist tab mounting the speaker onto a printed circuit board.
Figure 5:
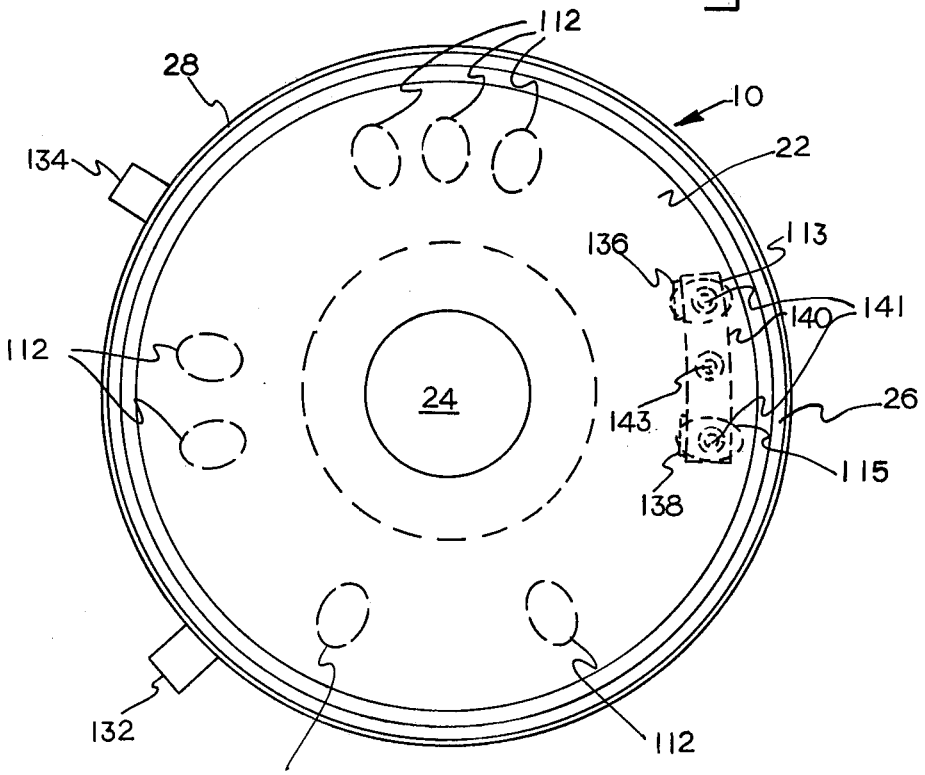
FIG. 5 is a top view looking in the direction of arrows 5—5 in FIG. 4.

Referring now to FIGS. 4 and 5, the frustoconical section of the basket 28 includes a number of circumferentially spaced openings 112 the purpose of which is to allow propagation of air outwardly from within the chamber 114 defined by the cone 22 and the basket 28. Because air can pass freely through these circumferentially spaced openings 112, there is developed neither superatmospheric pressure nor a vacuum in the chamber 114 and the acoustically developed vibrations of the cone 22 can propagate without the free movement of the cone and voice coil 30 being impeded. Absence of the openings 112 might cause lateral voice coil displacement into contact with the confronting surfaces defined by rounded surface 38 and confronting surface 62 of the post 14.

Figure 6:
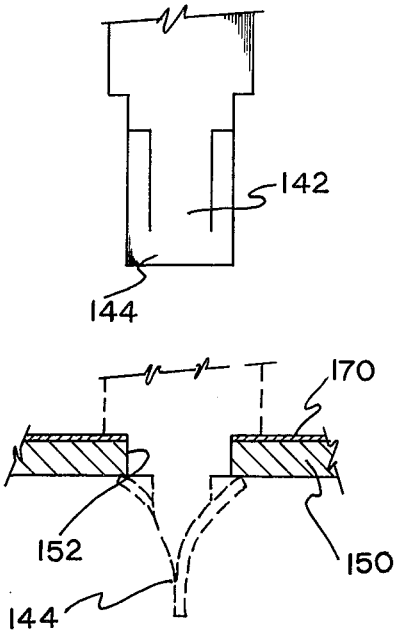
FIG. 6 is a detailed view illustrating only the tab end of a conductive twist tab which is twisted relative to a terminal opening in the PC board after insertion and shown fully connected in dotted line; and, FIG. 7 illustrates the shim gauge in detail view and illustrates how the projections appear before insertion through the post.

The voice coil is completed in its construction by dressing the leads 130 up the backside or inner surface of the cone 22 until they are a distance apart (FIGS. 1 and 4). The lead wires are then passed through openings 113, and 115 (FIGS. 1 and 5) in the housing 28 and are secured into electrical engagement with respective terminals 141 on a terminal strip 140 secured by rivet 143. As shown in FIGS. 1, 4 and 5, metal twist tab standoffs 132, 134, 136 and 138 serve to position and secure the loudspeaker 10 to the printed circuit board 150. Twist tab standoffs 136 and 138 are mechanically secured to the terminal strip 140 and electrically connected with terminals 141 and leads 130, thereby enabling electrical connection of the leads 130 with respective electrical conductors 166, 168 (Not Shown) on the board 150. As shown in detailed view FIG. 6, a twist tab end 142 is passed through slotted opening 152 in the board 150 and the lower end 144 is twisted thereby effecting a mechanical connection with the board and an electrical connection with an electrical conductor 170. This twist connection may be soldered to further enhance electrical connection with a printed circuit board electrical conductor.

As described, a one-piece cone or diaphragm 22 and dust cover 24 is achieved, and it should be noted that the resulting construction does not require a spider. The cone is formed by one hot forming and trimming operation from paper sheet into the correct cone shape so that the dust cover is not required as a separate piece but is incorporated directly into the dust cap cone. This eliminates standard gauging methods for assembly and enables the use of gear gauging means for proper location of the voice coil 30. Because of the proper location of the voice coil 30 by the shim gauge 70, the positioning, supporting, and biasing functions of a spider are eliminated and the functions are achieved by means of the integrally constructed cone and dust cover.

The frequency response of the assembled loudspeaker is found to be more than adequate and is in fact an improved function because of the concentration of gauss lines in the precise region of the voice coil disposed within a reduced air gap.

OPERATION AND METHOD OF ASSEMBLY

To assemble the loudspeaker, the back plate 12 has secured to it the annular magnet 20 and the base 50 of the basket or housing 28 is then secured to the base 36 of the magnet 20, with the air gap 60 being formed between the surface 38 of the turned back end 40 of the base 50 relative to the confronting surface 62 of post 14. Next, the bobbin 32 of the voice coil 30 is adhesively joined to the central portion of the diaphragm or cone 22, and the shim gauge 70 is inserted through the hollow core 16 of the post 14 with the cam bosses 82, 84, 86, 88 disposed outwardly to accurately position the bobbin and voice coil when such is lowered over the bosses thereby gauging the proper location of the voice coil within the gap 60 between the confronting surface 62 of post 14 and the rounded surface 38 of end 40. The peripheral pleated section 26 is then adhesively joined to the recess 102 of the basket 28 and once this connection is completed by appropriate air drying or heat drying, the gauge 70 is withdrawn from the post 14.

When electrical current of a variable amount is passed to the coil 30, there is developed a vibration or movement of the cone 22. Thus, an electrical energy signal is transduced to an acoustical signal. The developed acoustical signal is also communicated through openings 112 so that no superatmospheric pressure or vacuum is developed within the chamber 114. Because of the concentration of gauss lines and the uniformity of such gauss concentration within the limits of movement of the voice coil, there is an accurate response including a high degree of sensitivity so that the speaker has a full range of response from 500 Hz to 5000 Hz.

SUMMARY

The device is manufacturable in large scale and completely eliminates such previous expedients as a washer or top plate and a spider, and the voice coil is accurately located and reliably positioned in relation to a reduced size air gap wherein the gauss lines are concentrated. The accurate spacing of the voice coil is by means of a gauge which lends itself to large scale manufacture in relation to an integrally constructed cone and dust cap and securedly mounted bobbin. The result is a loudspeaker which lends itself to an added economy of manufacture by reason of the few number of component parts and the large scale of production.

It is reasonably to be expected that those skilled in the art can make numerous revisions and adaptations of the invention and it is intended that such revisions and adaptations will be included within the scope of the following claims as equivalents of the invention.

What is claimed as new and desired to be secured by Letters Patent of the United States is:

1. A method for constructing a loudspeaker comprising the steps of forming a one-piece diaphragm and dust cover member, joining to said member a bobbin and winding forming a voice coil, disposing the combination member and voice coil in relation to an air gap formed between a central portion of a metal housing mounted on a permanent magnet and a centrally disposed upwardly projecting integral post of a base plate upon which is mounted said magnet, thereafter precisely locating the voice coil within the air gap by inserting a gauge from the rear of said base plate through said post and into position defining relation with the interior surface of said bobbin, permanently fixing the adjusted position of said coil relative to said gap by securing the outer periphery of said diaphragm and dust cover member to an enlarged diameter section of the metal housing, and thereafter withdrawing said gauge.

2. The process in accordance with claim 1 including the step of forming apertures in the metal housing to provide venting during operation of the loudspeaker.

3. The process in accordance with claim 1 including the steps of forming a folded-over section of said housing in the region of the air gap to effect maximum gauss density in the gap region.

4. The process in accordance with claim 1 wherein the step of securing the member to the housing is effected by a glue connection characterized by air drying and rapid polymerization.

5. The process in accordance with claim 1 wherein the connection between said member and the enlarged diameter section of said housing is through heat hardenable resins effecting securement between confronting surfaces of the member and diameter section thereby maintaining the adjusted position of said voice coil in relation to the air gap.

6. The process in accordance with claim 1 wherein the diaphragm and dust cover member is formed from a fibrous material providing characteristics of frequency response from approximately 500 Hz to 5000 Hz.

7. The process in accordance with claim 6 in which the one-piece diaphragm and dust cover member is thereafter coated with a waterproofing material.

8. The process in accordance with claim 1 in which a standoff integral with said housing supports the loudspeaker.

9. The process in accordance with claim 1 in which a standoff is connected with said housing to provide support for said loudspeaker and electrical connection with an electrical conductor.

10. The process in accordance with claim 1 including the step of passing a voice coil lead wire along the under surface of the diaphragm portion of said member and through an aperture for connection with an electrical conductor.

* * * * *